US006412127B1

(12) United States Patent
Cuddy

(10) Patent No.: US 6,412,127 B1
(45) Date of Patent: Jul. 2, 2002

(54) HEAD CRADLE WITH BODY SUPPORT

(76) Inventor: Robert Cuddy, 1256 Paso Fino Dr., Warrington, PA (US) 18976

( * ) Notice: Subject to any disclaimer, the term of this patent is extended or adjusted under 35 U.S.C. 154(b) by 0 days.

(21) Appl. No.: 09/867,775

(22) Filed: May 30, 2001

(51) Int. Cl.[7] ..... A47C 20/00

(52) U.S. Cl. ..... 5/632; 5/638; 5/640; 5/645; 5/644

(58) Field of Search ..... 5/630, 632, 636, 5/638, 640, 644, 645

(56) References Cited

U.S. PATENT DOCUMENTS

| | | | | |
|---|---|---|---|---|
| 1,542,674 | A | | 6/1925 | Darling |
| 2,085,296 | A | * | 6/1937 | Carey ..... 128/889 |
| 2,107,962 | A | | 2/1938 | Sheasby |
| 2,795,802 | A | * | 6/1957 | Myers ..... 5/632 |
| 2,961,668 | A | * | 11/1960 | Hayes ..... 446/72 |
| 3,315,282 | A | | 4/1967 | Lowery et al. |
| 3,706,472 | A | | 12/1972 | Mertens |
| 3,926,181 | A | | 12/1975 | Eischen, Sr. |
| 3,946,452 | A | | 3/1976 | Eary, Sr. |
| 4,074,376 | A | | 2/1978 | Bond |
| 4,173,048 | A | | 11/1979 | Varaney |
| 4,206,524 | A | | 6/1980 | Cook |
| D255,966 | S | | 7/1980 | Stadel |
| 4,394,783 | A | | 7/1983 | Simmons |
| D284,248 | S | | 6/1986 | Challen |
| D286,239 | S | | 10/1986 | Scheurer et al. |
| 4,730,801 | A | | 3/1988 | Cloward |
| 4,790,042 | A | * | 12/1988 | Reich ..... 5/421 |
| 4,815,154 | A | | 3/1989 | Grimes |
| 4,891,854 | A | | 1/1990 | Finkelstein |
| 4,907,306 | A | | 3/1990 | Nakaji |
| D316,451 | S | | 4/1991 | Carnathan et al. |
| 5,079,786 | A | | 1/1992 | Rojas |
| 5,103,516 | A | | 4/1992 | Stevens |
| 5,426,798 | A | | 6/1995 | Guarino |
| D370,585 | S | | 6/1996 | Faithful |
| D376,288 | S | | 12/1996 | Antonian |
| D376,503 | S | | 12/1996 | Petersson |
| 5,586,351 | A | | 12/1996 | Ive |
| 5,630,651 | A | | 5/1997 | Fishbane |
| 5,632,050 | A | | 5/1997 | Zajas et al. |
| D380,835 | S | | 7/1997 | Peddy |
| D381,233 | S | | 7/1997 | Torbik |
| 5,644,809 | A | | 7/1997 | Olson |
| D382,163 | S | | 8/1997 | Hartney |
| D382,435 | S | | 8/1997 | Schaffner et al. |
| D383,026 | S | | 9/1997 | Torbik |
| D384,233 | S | | 9/1997 | Civitarese |
| D385,451 | S | | 10/1997 | Pujals, Jr. |
| D385,452 | S | | 10/1997 | Marti |
| 5,682,632 | A | | 11/1997 | Cotroneo |
| 5,685,613 | A | | 11/1997 | Franzen, Jr. |
| D389,645 | S | | 1/1998 | Ermini |
| 5,708,998 | A | | 1/1998 | Torbik |
| D390,404 | S | | 2/1998 | Hargest et al. |
| D392,146 | S | | 3/1998 | Gregg |
| D392,495 | S | | 3/1998 | Baousson |
| 5,743,271 | A | | 4/1998 | Royo-Salvador |
| D399,675 | S | | 10/1998 | Ferris |
| D402,494 | S | | 12/1998 | Langer |
| D404,239 | S | | 1/1999 | Denney |
| D409,038 | S | | 5/1999 | Rojas, Jr. et al. |
| 5,899,206 | A | | 5/1999 | La Chappelle-Reynolds |
| 5,916,088 | A | | 6/1999 | Gueli |
| 5,933,890 | A | | 8/1999 | Codd |
| D414,368 | S | | 9/1999 | Wingard |
| 5,964,504 | A | | 10/1999 | Hogan et al. |
| 5,970,546 | A | | 10/1999 | Danis |

(List continued on next page.)

*Primary Examiner*—Michael F. Trettel
(74) *Attorney, Agent, or Firm*—Caeser, Rivise, Bernstein, Cohen & Pokotilow, Ltd.

(57) ABSTRACT

An apparatus for supporting the head of user while the user is lying in a face-down position, a face-up position or a side position. The apparatus includes a head cradle with air holes and a pair of elongated dependent arms that can be manipulated to serve as a chest support, or a neck support or a head support depending on how the user is lying.

15 Claims, 5 Drawing Sheets

U.S. PATENT DOCUMENTS

| | | | | | |
|---|---|---|---|---|---|
| D416,428 | S | | 11/1999 | Jackson | |
| 5,979,981 | A | | 11/1999 | Dunne et al. | |
| 6,003,177 | A | | 12/1999 | Ferris | |
| D418,711 | S | | 1/2000 | Mettler | |
| 6,009,577 | A | | 1/2000 | Day | |
| 6,010,192 | A | | 1/2000 | King | |
| D420,845 | S | | 2/2000 | Rumage | |
| 6,023,797 | A | | 2/2000 | Brumfield | |
| 6,033,023 | A | | 3/2000 | Strassner et al. | |
| 6,036,263 | A | | 3/2000 | Gold | |
| 6,038,720 | A | | 3/2000 | Matthews et al. | |
| 6,042,184 | A | | 3/2000 | Kofoed | |
| 6,052,848 | A | * | 4/2000 | Kelly | 5/630 |
| 6,076,213 | A | | 6/2000 | Chase, Jr. | |
| 6,081,947 | A | | 7/2000 | Disher | |
| 6,088,854 | A | * | 7/2000 | Brownrigg | 5/632 |
| 6,088,855 | A | | 7/2000 | Connolly | |
| 6,095,611 | A | | 8/2000 | Bar et al. | |
| 6,116,691 | A | | 9/2000 | Reece | |
| 6,123,389 | A | | 9/2000 | O'Connor et al. | |
| 6,128,797 | A | | 10/2000 | Shaffer | |
| 6,148,460 | A | | 11/2000 | Fried et al. | |
| 6,151,734 | A | | 11/2000 | Lawrie | |
| D434,588 | S | | 12/2000 | Allan | |
| D434,589 | S | | 12/2000 | Mocke-Maxwell | |
| D434,936 | S | | 12/2000 | May | |
| 6,253,400 | B1 | * | 7/2001 | Rudt-Sturzenegger et al. | 5/630 |

* cited by examiner 30A
28
36
54
30B
30C
30H
30D
30G
26
30E
52
30F
50A
50B
48A
48B
44A
44B
46
46
48
40
48
40
40
41B
42
42
42
42
41A
40
56A
56B

HEAD CRADLE WITH BODY SUPPORT

FIELD OF THE INVENTION

The invention generally relates to support cushions, and more particularly, to a head cradle including a body support for supporting the user's face, head and even chest while in a lying position.

BACKGROUND OF INVENTION

The use of head support cushions is well-known in the art. Examples of such head support cushions are: U.S. Pat. No. 1,542,674 (Darling); U.S. Pat. No. 2,107,962 (Sheasby); U.S. Pat. No. 2,795,802 (Myers); U.S. Pat. No. 3,315,282 (Lowery et al.); U.S. Pat. No. 3,926,181 (Eischen, Sr.); U.S. Pat. No. 4,074,376 (Bond); U.S. Pat. No. 4,730,801 (Cloward); U.S. Pat. No. 4,891,854 (Finkelstein); U.S. Pat. No. 4,907,306 (Nakaji); U.S. Pat. No. 5,632,050 (Zajas et al.); U.S. Pat. No. 5,682,632 (Cotroneo); U.S. Pat. No. 5,970,546 (Danis); U.S. Pat. No. 6,042,184 (Kofoed); U.S. Pat. No. 6,052,848 (Kelly); U.S. Pat. No. 6,128,797 (Shafer); U.S. Pat. No. D416,428 (Jackson) and U.S. Pat. No. D420,845 (Rumage).

However, none of the above teach or suggest an apparatus that can be used for a variety of head positions without the need to introduce an new or external member, or whereby a portion of the apparatus can be formed to provide a support for a different head position.

Therefore, there remains a need for a head support for a user in a lying position, either face-up, face down or on the side and which includes body support members that can be manipulated to form a chest support, a neck support or a portion of the head support.

SUMMARY OF THE INVENTION

An apparatus for supporting the head of a user while the user is lying in a face-down position, a face-up position or a side position. The apparatus comprises: a head cradle for receiving a portion of the user's head; and at least two elongated arms that are coupled to the head cradle and wherein the at least two elongated arms are manipulable to form a chest support or a neck support or a head support.

A method for supporting both the head and chest of a user lying in a face down position. The method comprises the steps of: (a) providing a head cradle that includes an oval-shaped opening and air holes for supporting the head of a user lying face down thereon; (b) providing at least two tapered elongated arms that are coupled to a portion of the head cradle at a first end and having free ends; and (c) extending the free ends of the at least two tapered elongated arms away from the head cradle for supporting the chest of the user thereon.

A method for supporting both the head and neck of a user lying in a face up position. The method comprises the steps of: (a) providing a head cradle that includes an oval-shaped opening for supporting the head of a user lying face up thereon; (b) providing at least two elongated arms that are coupled to a portion of the head cradle at a first end and having free ends and wherein the free ends are manipulated into a transverse position at a bottom surface of the head cradle for supporting the back of the neck of the user.

A method for supporting the head of a user lying in a side position. The method comprising the steps of: (a) providing a head cradle that includes an oval-shaped opening for supporting the head of a user lying face up thereon; (b) providing at least two elongated arms that are coupled to a portion of the head cradle at a first end and having free ends and wherein the free ends are releasably secured to the head cradle to cover a substantial portion of said oval-shaped opening for supporting the side of the head of the user thereon.

DETAILED DESCRIPTION OF THE PREFERRED EMBODIMENTS

Figure 1:
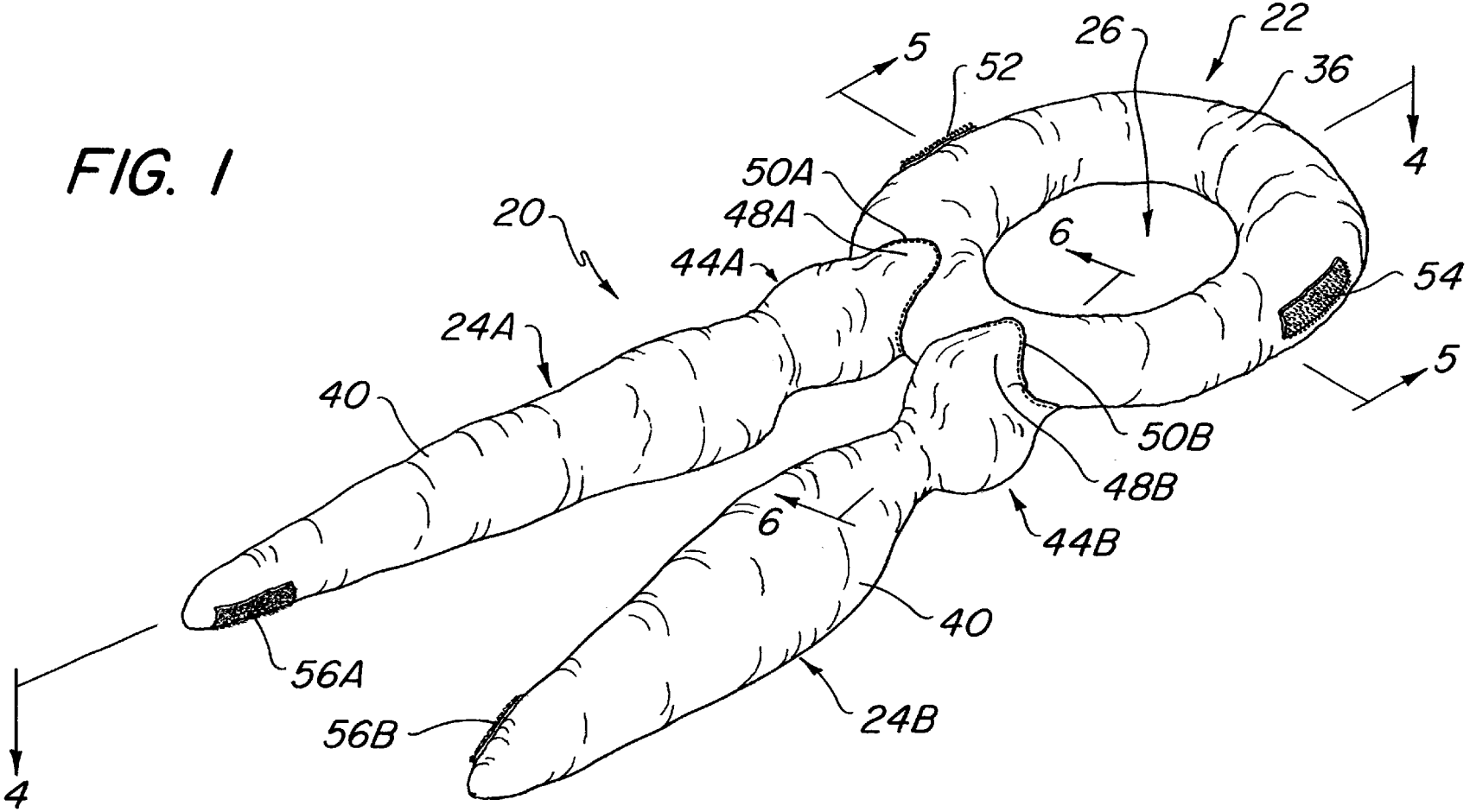
FIG. 1 is an isometric view of the head cradle with body support.

Referring now in detail to the various figures of the drawing wherein like reference characters refer to like parts, there is shown at 20 a head cradle with body support (hereinafter "apparatus 20"). The apparatus 20 basically comprises a head cradle 22 and depending arms 24A and 24B that can be manipulated in different positions. The apparatus 20 is used by a person in a lying position, such as on a beach, treatment/examination table, bed, couch, lounge chair, etc. As will be discussed in detail later, the apparatus 20 can be used as a face/chest support (FIG. 7), as a head and neck support (FIG. 8) or as a side head support (FIG. 9).

Figure 5:
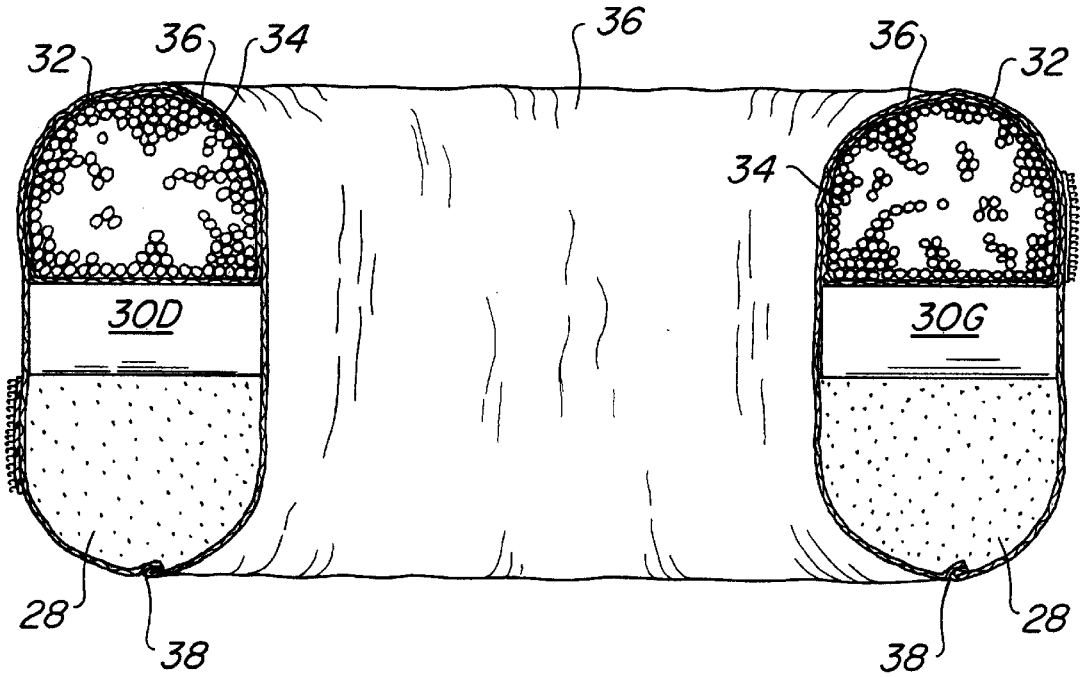
FIG. 5 is a cross-sectional view of the invention taken along line 5—5 of FIG. 1.

In particular, the head cradle 22 is ring-like or annular-shaped having an inner portion 26 that conforms to the shape of a human face (e.g., an oval). As shown most clearly in FIG. 5, the head cradle 22 comprises four parts:

- a rigid foam material 28 that is also annular-shaped;
- a plurality of flexible plastic tubes 30A–30H (FIG. 4) positioned in recesses (not shown) in the rigid foam material 28;
- an annular-shaped fabric 32 filled with beads 34 that is positioned on top of the plastic tubes 30A–30H and the rigid foam material 28; and
- an outer fabric 36 that contains all of these components and which utilizes a single seam 38 (FIG. 4) to close the fabric 36 around these components.

The plurality of tubes 30A–30H permits the passage of air into/out of the inner portion 26 when the user is lying with his/her face down on the head cradle 22. The bead filled fabric 32 provides a flexible cushion that conforms to the head of the user, whether the user is lying face-down or head-up.

It should be understood that term "annular-shaped" or "ring-like" as used throughout this Specification implies that the inner portion 26 of the head cradle 22 comprises a shape that conforms to the shape of the human face (e.g., oval) but does not require that the outside periphery of the head cradle 22 be circular, round, oval, etc. In fact, the outside periphery of the head cradle 22 can assume almost any shape.

Figure 6:
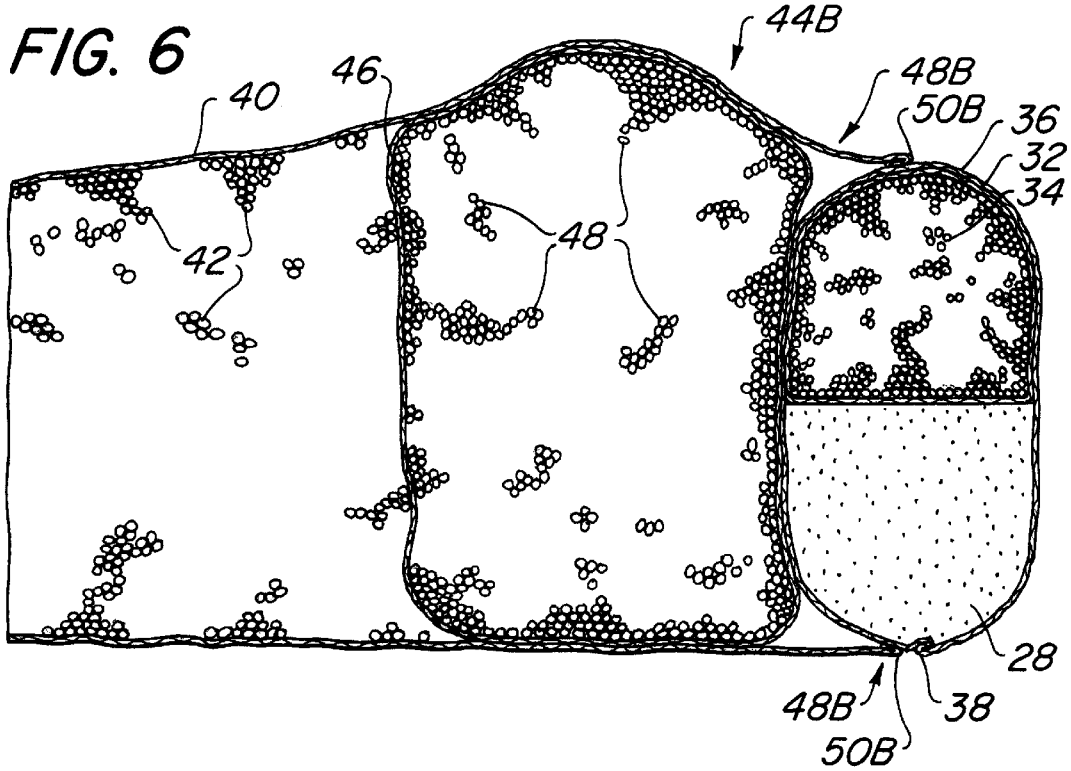
FIG. 6 is a cross-sectional view of the invention taken along line 6—6 of FIG. 1.

As shown in FIG. 6, each of the dependent arms 24A and 24B comprises a fabric 40 (similar to fabric 36) that is also filled with beads 42 (similar to the beads 34). The fabric 40 is closed by a single seam 41A and 41B for each of the arms 24A/24B, which is shown underneath the dependent arms 24A and 24B in FIG. 4. The upper portions 44A and 44B (FIG. 1) of each of the dependent arms 24A/24B comprise an internal fabric 46 also filled with beads 48. This bead-filled internal fabric 46 acts as a shoulder support for each dependent arm 24A/24B when the user is lying face down with his/her head in the inner portion 26, as will be discussed in detail later. When the dependent arms 24A and 24B are to be attached to the head cradle 22, the bead-filled fabric 46 is positioned in the upper portion 44A and 44B of the dependent arm fabric 40 (which itself has been substantially filled with the beads 42). The upper ends 48A and 48B of the dependent arm fabric 40 are then sewn with a seam 50A and 50B to the head cradle 22. Thus, the seams 50A and 50B also act as pivot locations for the dependent arms 24A/24B with respect to the head cradle 22.

Both the rigid foam material 28 and the beads (34, 42, 48) may comprise latex-covered closed cell foam rubber which are non-absorbant to water. All of the fabrics 32, 36, 40 and 46 comprise a washable (e.g., cold water/delicate cycle) material. The outer fabrics 36 and 40 may comprise a light color to assist in reflecting, rather than absorbing, heat especially when the apparatus 20 is used on the beach or any outdoor activity where the user is exposed to the sun. Furthermore, the outer fabric 36 is also a breathable material in order to allow the passage of air in and out of the plurality of tubes 30A–30H in the head cradle 22. The material of the outer fabrics 36 and 40 also are amenable to having print placed thereon.

Figure 2:
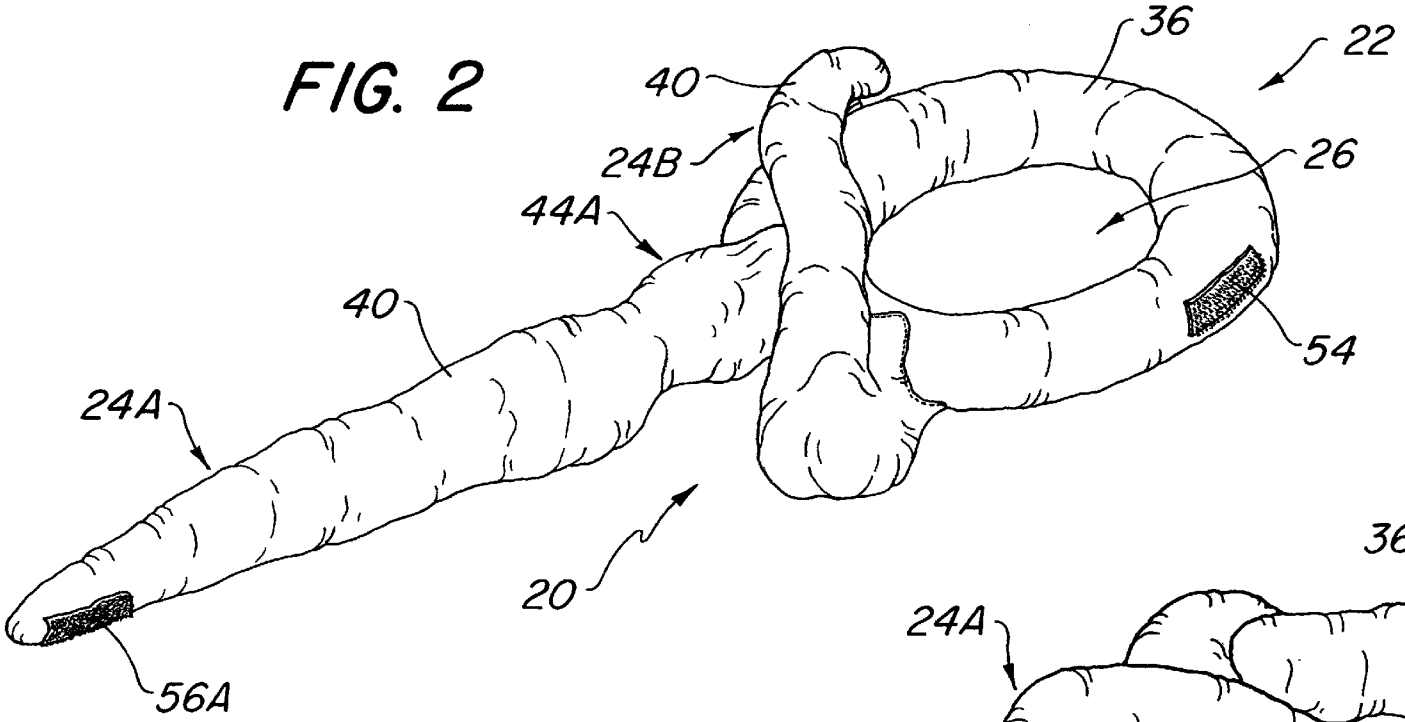
FIG. 2 is an isometric view of the invention of FIG. 1 but with one of the depending arms positioned over the opening of the head support.
Figure 3:
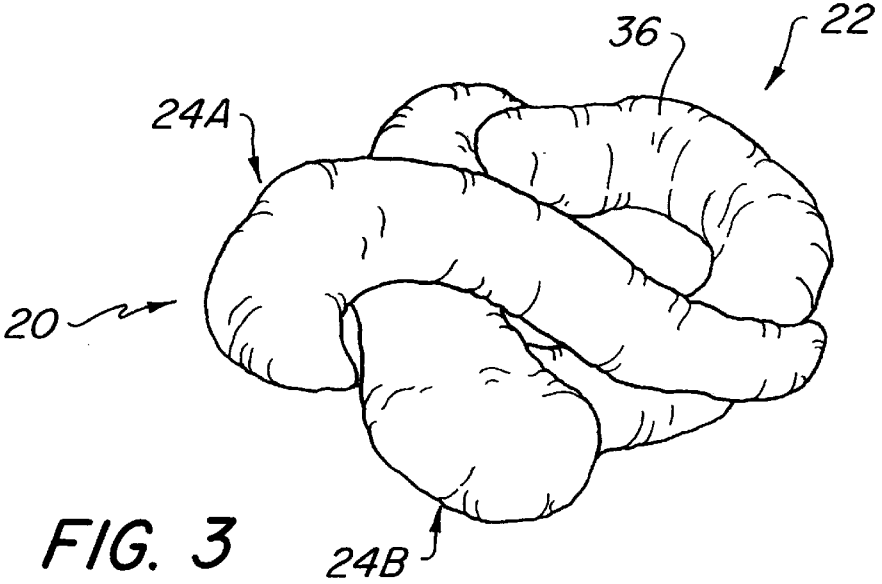
FIG. 3 is an isometric view of the invention of FIG. 1 depicting both depending arms positioned over the opening of the head support.
Figure 4:
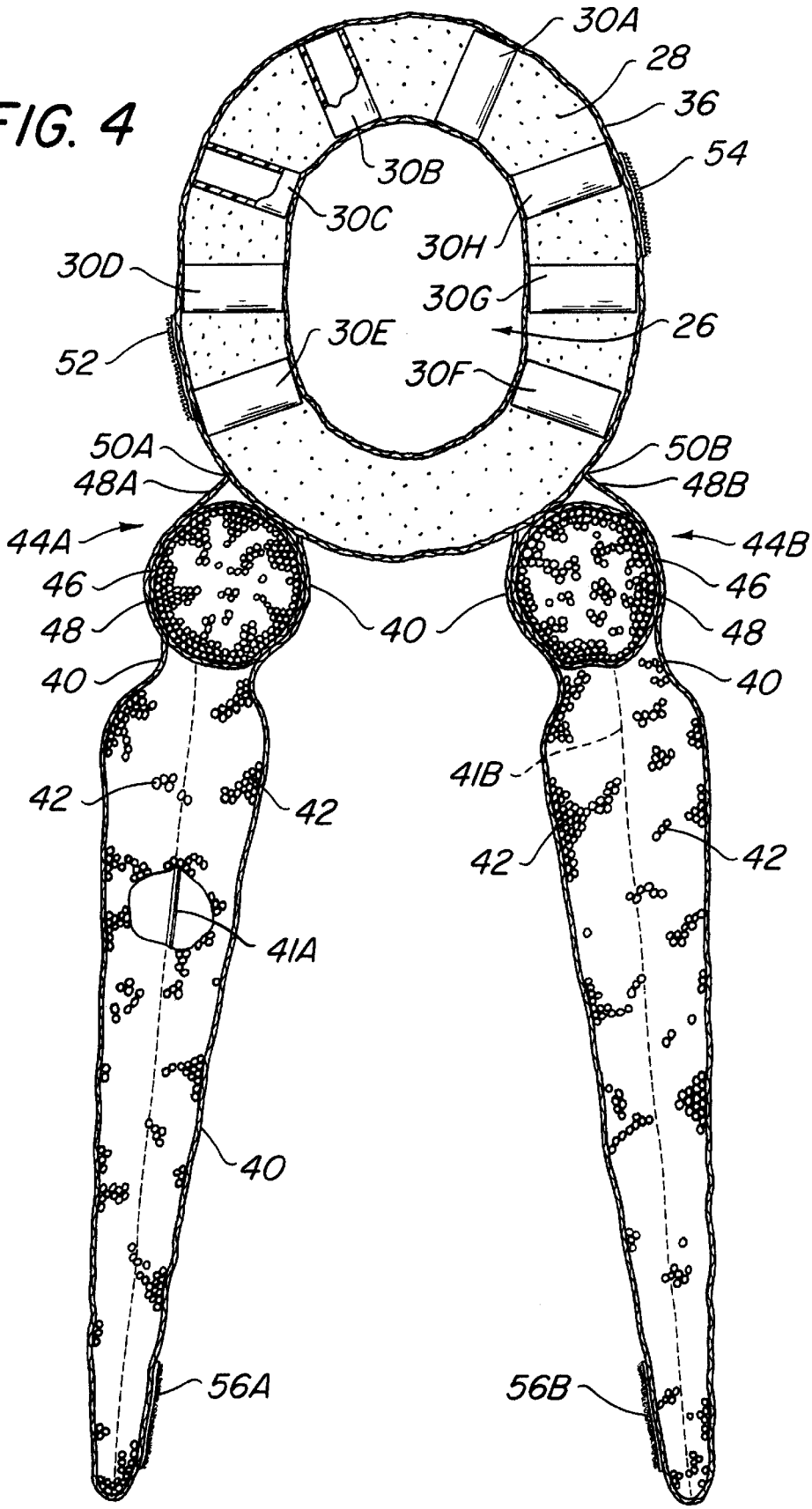
FIG. 4 is a cross-sectional view of the invention taken along line 4—4 of FIG. 1.

To permit the dependent arms 24A and 24B to be manipulated to provide the different supports of the apparatus 20, a releasably securement mechanism is provided. A hook/pile arrangement (e.g., Velcro®) can be implemented to achieve this. For example, the head cradle 22 comprises a first hook strip 52 and a second hook strip 54 that are disposed on the sides, as shown in FIGS. 1 and 4. Furthermore, the inside surface of the free ends of the dependent arms 24A/24B comprise corresponding pile strips 56A and 56B. Thus, as shown in FIG. 2, the dependent arm 24B is folded over the head cradle 22 and the first hook strip 52 is engaged with the pile strip 56B. Then, as shown in FIG. 3, the other dependent arm 24A is then folded over the folded dependent arm 24B and head cradle 22 and the second hook strip 54 is engaged with the pile strip 56A. It should be noted that when the dependent arm 24A is folded over the already-folded dependent arm 24B, the force needed to engage the second hook strip 54 with the pile strip 56A causes the dependent arms 24A/24B to cover a substantial portion of the inner portion 26, thereby providing a head support as shown in FIG. 9.

It should also be noted that, although not shown, the bottom surface of the head cradle 22 may also comprise a hook/pile configuration for releasably coupling the head cradle 22 to an auxiliary member that is secured to a recreational device, e.g., a raft. Thus, the auxiliary member can be attached to the raft and then the head cradle 22 releasably secured to the auxiliary member. In this manner, the apparatus 20 can be used on a raft, or other recreational vehicle, without the apparatus 20 sliding off.

Figure 7:
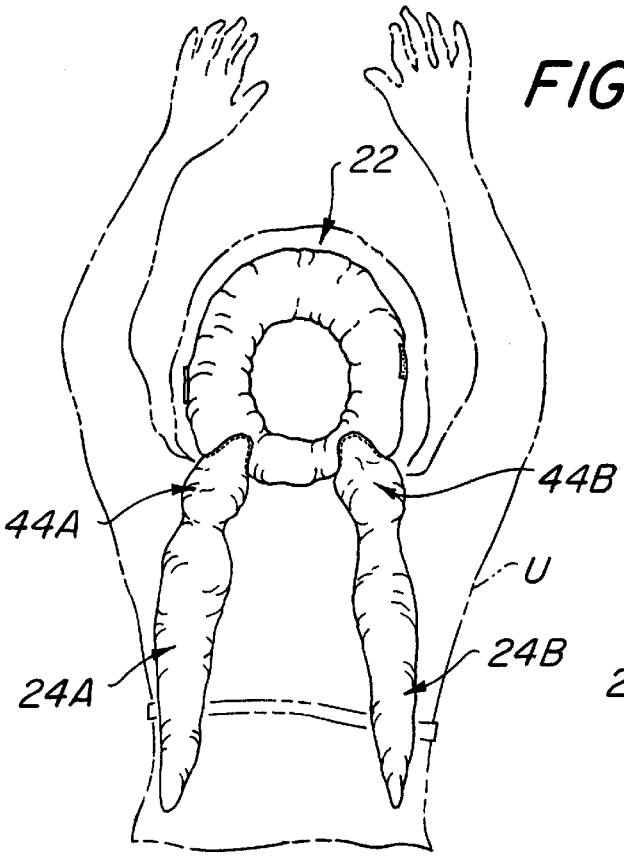
FIG. 7 is a top plan view of the invention with a user, shown in phantom, lying face down on the invention.

When the apparatus 20 is to be used as a face/chest support as shown in FIG. 7, the dependent arms 24A/24B are placed in their elongated position. The user U then lies face down by placing his/her face into the inner portion 26. The users's U chest/upper torso is supported on the dependent arms 24A/24B, with each of the shoulders being supported by the upper portions 44A/44B of the dependent arms 24A/24B; the arms 24A/24B are tapered to provide appropriate support to the chest. In this position, the user U can breathe normally due to the presence of the plurality of tubes 30A–30H. The bean-filled annular-shaped fabric 32 inside the head cradle 22 provides a soft conforming surface against which the user's face rests.

Figure 8:
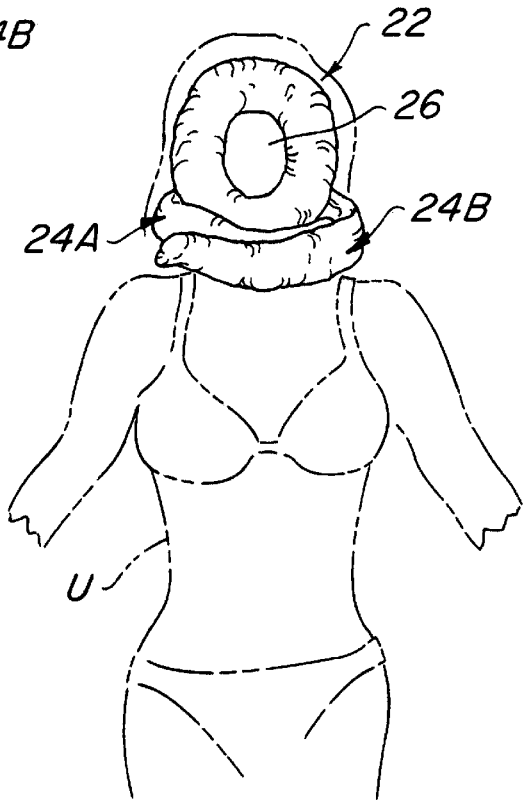
FIG. 8 is a top plan view of the invention with a user, shown in phantom, lying on her back, face up, with her head positioned in the head cradle and with the depending arms folded to provide a neck support.
Figure 9:
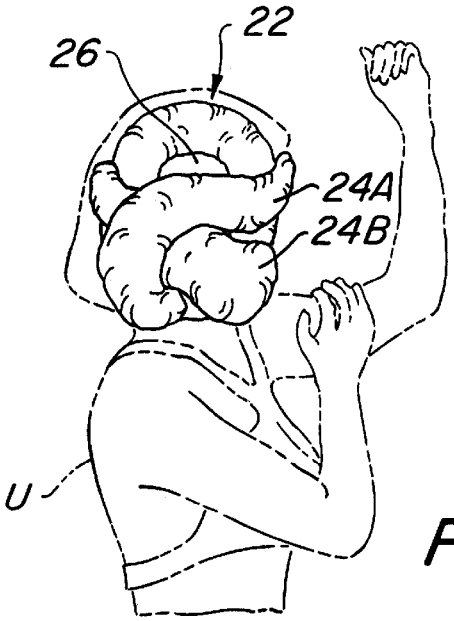
FIG. 9 is a top plan view of the invention with a user, shown in phantom, lying on her side with her head positioned in the head cradle and with the depending arms folded over the opening in the head cradle to provide a head support.

When the apparatus 20 is to be used as a head and neck support as shown in FIG. 8, the user U folds the dependent arms 24A/24B into a somewhat transverse position at the base, or bottom surface, of the head cradle 22. The user U then lies with the back of his/her head positioned in the inner portion 26.The user U can adjust the height of the neck support, formed by these folded dependent arms 24A/24B, by moving the arms 24A/24B back and forth. Also, the bean-filled annular-shaped fabric 32 inside the head cradle 22 again provides a soft conforming surface for the back of the user's head.

When the apparatus 20 is to be used as a side head support as shown in FIG. 9, the apparatus 20 is folded as described earlier with respect to FIGS. 2-3. In that configuration, the inner portion 26 is covered by the dependent arms 24A/24B and therefore the user U can lie with the side of his/her head on top of the folded dependent arms 24A/24B.

Without further elaboration, the foregoing will so fully illustrate my invention that others may, by applying current or future knowledge, readily adopt the same for use under various conditions of service.

I claim:

1. An apparatus for supporting the head of a user while the user is lying in a face-down position, a face-up position or a side position, said apparatus comprising:

head cradle for receiving a portion of the user's head;

at least two elongated arms that are coupled to said head cradle and wherein said at least two elongated arms are manipulable to form a chest support or a neck support or a head support; and wherein said head cradle comprises an inner opening that receives the head of a user.

2. The apparatus of claim 1 wherein said head cradle comprises:

a first annular-shaped rigid foam material;

a plurality of lumens positioned on said first annular-shaped rigid foam material in radial positions around said first annular-shaped rigid foam material;

a second annular-shaped fabric comprising beads therein and disposed on top of said lumens and said first annular-shaped rigid foam material; and a first fabric enclosing said first annular-shaped rigid foam material, said plurality of lumens and said second annular-shaped.

3. The apparatus of claim 2 wherein said rigid foam material comprises latex covered closed cell foam rubber.

4. The apparatus of claim 2 wherein said beads comprise latex-covered closed cell foam rubber.

5. The apparatus of claim 3 wherein each of said at least two elongated arms comprises a second fabric filled with beads that is coupled to said head cradle to form pivot locations.

6. The apparatus of claim 5 wherein each of said at least two elongated arms are tapered.

7. The apparatus of claim 5 wherein each of said at least two elongated arms further comprises a third fabric filled with beads and wherein said third fabric filled with beads is positioned inside said second fabric filled with beads adjacent said pivot locations, said third fabric filled with beads forming shoulder supports for a user lying face down with his/her head on said head cradle.

8. The apparatus of claim 5 wherein said beads comprise latex-covered closed cell foam rubber.

9. The apparatus of claim 1 wherein said at least two elongated arms comprise free ends and wherein each of said free ends comprises a first portion of a releasable securing mechanism and wherein said head cradle comprises a second corresponding portion of said releasable securing mechanism that permits the free ends of said at least two elongated arms to be releasably secured to said head cradle to form a head support that permits a user to lie sideways with his/her head positioned on said head cradle.

10. The apparatus of claim 9 wherein said releasable securing mechanism comprises a hook/pile.

11. The apparatus of claim 1 wherein said at least two elongated arms comprise free ends and wherein said at least two elongated arms can be positioned closely adjacent a bottom surface of said head cradle to form a neck support for a user lying with the back side of his/her head in said head cradle.

12. A method for supporting both the head and chest of a user lying in a face down position, said method comprising the steps of:

(a) providing a head cradle that includes an oval-shaped opening and air holes for supporting the head of a user lying face down thereon;

(b) providing at least two tapered elongated arms that are coupled to a portion of the head cradle at a first end and having free ends; and (c) extending said free ends of said at least two tapered elongated arms away from said head cradle for supporting the chest of the user thereon.

13. A method for supporting both the head and neck of a user lying in a face up position, said method comprising the steps of:

(a) providing a head cradle that includes an oval-shaped opening for supporting the head of a user lying face up thereon;

(b) providing at least two elongated arms that are coupled to a portion of the head cradle at a first end and having free ends, said free ends being manipulated into a transverse position at a bottom surface of said head cradle for supporting the back of the neck of the user.

14. A method for supporting the head of a user lying in a side position, said method comprising the steps of:

(a) providing a head cradle that includes an oval-shaped opening for supporting the head of a user lying face up thereon;

(b) providing at least two elongated arms that are coupled to a portion of the head cradle at a first end and having free ends, said free ends being releasably secured to said head cradle to cover a substantial portion of said oval-shaped opening for supporting the side of the head of the user thereon.

15. The method of claim 14 wherein said step of providing at least two elongated arms comprises:

(a) releasably securing the free end of one of said at least two elongated arms to a first side of said head cradle; and (b) releasably securing the free end of the other one of said at least two elongated arms to a second side, opposite said first side, of said head cradle, said other one of said at least two elongated arms overlapping said one of said at least two elongated arms to cover said substantial portion of said oval-shaped opening.

* * * * *